United States Patent [19]

Ushigami et al.

[11] Patent Number: 4,997,493

[45] Date of Patent: Mar. 5, 1991

[54] PROCESS FOR PRODUCTION OF DOUBLE-ORIENTED ELECTRICAL STEEL SHEET HAVING HIGH FLUX DENSITY

[75] Inventors: Yoshiyuki Ushigami; Yozo Suga; Tadashi Nakayama; Nobuyuki Takahashi, all of Kitakyushu, Japan

[73] Assignee: Nippon Steel Corporation, Tokyo, Japan

[21] Appl. No.: 276,856

[22] Filed: Nov. 28, 1988

[30] Foreign Application Priority Data

| | | | |
|---|---|---|---|
| Nov. 27, 1987 | [JP] | Japan | 62-297825 |
| Apr. 21, 1988 | [JP] | Japan | 63-99069 |
| Nov. 22, 1988 | [JP] | Japan | 63-293645 |

[51] Int. Cl.[5] ..... H01F 1/047

[52] U.S. Cl. ..... 148/111

[58] Field of Search ..... 148/111

[56] References Cited

U.S. PATENT DOCUMENTS

| | | | |
|---|---|---|---|
| 1,965,559 | 7/1934 | Goss | 175/21 |
| 3,130,095 | 4/1964 | Kohler et al. | 148/113 |
| 3,136,666 | 6/1964 | Taguchi et al. | 148/111 |
| 3,159,511 | 12/1964 | Taguchi et al. | 148/111 |
| 3,163,564 | 12/1964 | Taguchi et al. | 148/111 |
| 3,640,780 | 2/1972 | Stanley | 148/111 |
| 3,932,234 | 1/1976 | Imanaka et al. | 148/112 |

FOREIGN PATENT DOCUMENTS

| | | |
|---|---|---|
| 35-17208 | 11/1960 | Japan . |
| 38-8213 | 6/1963 | Japan . |
| 40-15644 | 7/1965 | Japan . |
| 51-13469 | 4/1976 | Japan . |
| 62-45007 | 9/1987 | Japan . |

*Primary Examiner*—Melvyn J. Andrews

*Attorney, Agent, or Firm*—Wenderoth, Lind & Ponack

[57] ABSTRACT

In the conventional process for the production of a double-oriented electrical steel sheet, the preparation steps are complicated and the manufacturing cost is very high. Nevertheless, the magnetization characteristic $B_{10}$ is lower than 1.85 Tesla and the final sheet thickness cannot be reduced below 0.30 mm. According to the present invention, by strictly controlling the secondary recrystallization temperature and performing a third cold rolling in the same direction as the rolling direction of the first cold rolling, the magnetization characteristic $B_{10}$ can be increased above 1.88 Tesla and the final sheet thickness can be reduced to 0.20 mm. Moreover, a double-oriented electrical steel sheet having an excellent shape (flatness) and a much smaller thickness deviation in the longitudinal direction of the product can be produced on an industrial scale. Therefore, this product can be effectively used as a core material of a large-size rotary machine or in a small-size static magneto-electronic device.

20 Claims, 6 Drawing Sheets

(a) 1000°C (b) 1200°C

ORIENTATION OF GRAINS FORMED BY SECONDARY RECRYSTALLIZATION (200) POLE FIGURE

PROCESS FOR PRODUCTION OF DOUBLE-ORIENTED ELECTRICAL STEEL SHEET HAVING HIGH FLUX DENSITY

BACKGROUND OF THE INVENTION (1) Field of the Invention

The present invention relates to a process for the production of a double-oriented electrical steel sheet composed of crystal grains having <001> orientations of easy magnetization axes in the longitudinal direction of the steel sheet (strip) and the direction orthogonal to the longitudinal direction and having a {100} plane ({100}<001> expressed by Miller indices) appearing on the rolled face.

(2) Description of the Related Art

A grain-oriented electrical steel sheet which is especially magnetized (the flux density is high) in the rolling direction (longitudinal direction) of the steel sheet (strip) and has a small watt loss has been heretofore produced typically by the process disclosed in the specification of U.S. Pat. No. 1,965,559. This grain-oriented electrical steel sheet is composed of crystal grains having a {110} plane appearing on the rolled face and a <001} orientation ({110}<001> expressed by Miller indices) as the easy magnetization axis only in the rolling direction (the longitudinal direction of the steel sheet).

Compared with the grain-oriented electrical steel sheet having excellent magnetic characteristics only in the rolling direction (for example, the $B_{10}$ value in the rolling direction is 1.92 Tesla while the $B_{10}$ value in the direction orthogonal to the rolling direction is 1.45 Tesla), a double-oriented electrical steel sheet is advantageously used as the iron core material for a large-size rotary machine because the double-oriented electrical steel sheet has easy magnetization axes in both the longitudinal direction of the steel sheet (strip) and the direction orthogonal to the longitudinal direction of the steel sheet (strip) and has excellent magnetic characteristics in both directions.

On the other hand, a cold-rolled, non-oriented electrical steel sheet in which the easy magnetization axis is not highly integrated is generally used in a small-size rotary machine. If the double-oriented electrical steel sheet is used in this type of machine, a reduction of the size of the machine and an increased efficiency can be very effectively obtained.

The double-oriented electrical steel sheet has superior magnetic characteristics compared to those of the grain-oriented electrical steel sheet, but the doubleoriented electrical steel sheet has not been manufactured as an industrial product.

As the bench-scale process for the production of a double-oriented electrical steel sheet, the following two processes have been published, but each involves problems as industrial-scale preparation processes.

One prior art process is disclosed in the specification of U.S. Pat. No. 3,130,095. In this process, the material is subjected to high-temperature annealing in an atmosphere containing a polar gas such as hydrogen sulfide to control the surface energy and selectively grow grains in the {100}<001> orientation.

In this process, however, it is necessary to strictly control the atmosphere on the surface of the steel sheet, and the process is not suitable for mass production.

The other prior art process is a process proposed by Satoru Taguchi et al in the specification of U.S. Pat. No. 3,163,564, in which the dispersed precipitates are controlled. This process is a cross-cold-rolling process in which first a cold rolling is performed in one direction and second a cold rolling is carried out in the direction orthogonal to the first rolling direction. In this cross cold rolling process, a method is adopted in which, after the first cold rolling, the strip is cut into a predetermined length to form a steel sheet and the steel sheet is subjected to the second cold rolling in the direction orthogonal to the first cold rolling direction, or a method in which the cut sheet is turned by 90° so that both side edges of the strip subjected to the first cold rolling are welded to form a strip and the second rolling is subsequently performed.

For the manufacturer, these methods are complicated and it is difficult to obtain steel sheets having a uniform shape, and for the users, these methods are not satisfactory. More specifically, where the material is supplied in the form of a sheet, the efficiency of the punching operation is very low, and where the material is supplied in the form of a strip coil, welded parts appear at intervals, and since the magnetic property is insufficient thereat, the welded parts must be removed.

Accordingly, for the reasons mentioned above, double-oriented electrical steel sheets manufactured by the conventional techniques are not used as industrial products.

In addition to the above-mentioned problems, the technique disclosed in the specification of U.S. Pat. No. 3,163,564 involves a serious problem which prevents industrial use of the process. More specifically, according to this cross cold rolling process, a product having relatively high magnetization characteristics ($B_{10}$ value) can be obtained, but these magnetization characteristics do not match the high manufacturing cost due to the complications of the preparation process. Therefore, the product is not superior to the conventional grain-oriented electrical steel sheet. Moreover, since the development of the technique disclosed in U.S. Pat. No. 3,159,511 (Japanese Examined Patent Publication No. 40-15644) and U.S. Pat. No. 3,932,234 (Japanese Examined Patent Publication No. 51-13469), the magnetization characteristics ($B_{10}$ value) of the grain-oriented electrical steel sheet have been rapidly improved, and the requirement of $B10 \geqq 1.89$ Tesla is stipulated in JIS, and products having a $B_{10}$ value of about 1.92 Tesla are now marketed.

Under this background, the double-oriented electrical steel sheet should have magnetization characteristics comparable to those of the grain-oriented electrical steel sheet. As a means of improving the magnetization characteristics of the double-oriented steel sheet, Japanese Examined Patent Publication No. 38-8213 proposes a process in which a hot-rolled material is annealed and then cold-rolled in directions orthogonal to each other. But the magnetization characteristics obtained by this process are not satisfactory.

The iron core material should have excellent watt loss characteristics (small watt loss value, W/kg) as well as the above-mentioned magnetization characteristics. An increase of the $B_{10}$ value and reduction of the thickness of the product are especially effective for improving the watt loss characteristics. In the field of grain-oriented electrical steel sheets, JIS stipulates that the thickness should be as thin as 0.23 mm, but in a steel sheet having such a small thickness, it is very difficult to obtain highly oriented {100}<001> grains. Even in the processes disclosed in the specification of U.S. Pat. No. 3,163,564 and Japanese Examined Patent Publication No. 38-8213, the final thickness attainable is 0.30 mm or more, and the $B_{10}$ value of the obtained product is 1.85 Tesla at highest. As a means of eliminating this disadvantage, U.S. Pat. No. 3,136,666 (Japanese Examined Patent Publication No. 35-17208) proposes an improved technique, but in this improved technique, cold rolling and annealing are added, and therefore, the manufacturing cost is drastically increased.

SUMMARY OF THE INVENTION

A primary object of the present invention is to provide a technique of preparing a double-oriented electrical steel sheet having high magnetic characteristics, especially a thin product having a thickness smaller than 0.30 mm, at a low manufacturing cost.

Another object of the present invention is to provide a technique for preparing a double-oriented electrical steel sheet having excellent magnetic characteristics, which can be consistently produced in the form of a strip which has uniform magnetic characteristics in the length direction thereof, i.e., no portions thereof have uneven magnetic characteristics due to the presence of welded parts, which has an excellent uniformity of thickness and an excellent shape (flatness), and which can be continuously punched when formed into an iron core.

More specifically, by strictly controlling the secondary recrystallization, a double-oriented electrical steel sheet having, in two directions, a flux density comparable to the highest level of the flux density of the conventional grain-oriented electrical steel sheet is prepared. Furthermore, a third cold rolling carried out after the cross cold rolling is carried out in the same direction as the direction of the first cold rolling, and thus the thickness is uniformalized in the length direction of the material and the shape of the material is improved.

BRIEF DESCRIPTION OF THE DRAWINGS

FIG. 2(*b*) is a (200) pole figure illustrating the grain orientation of a product in which the secondary crystallization has been completed at 1200° C.;

DESCRIPTION OF THE PREFERRED EMBODIMENTS

Figure 1:
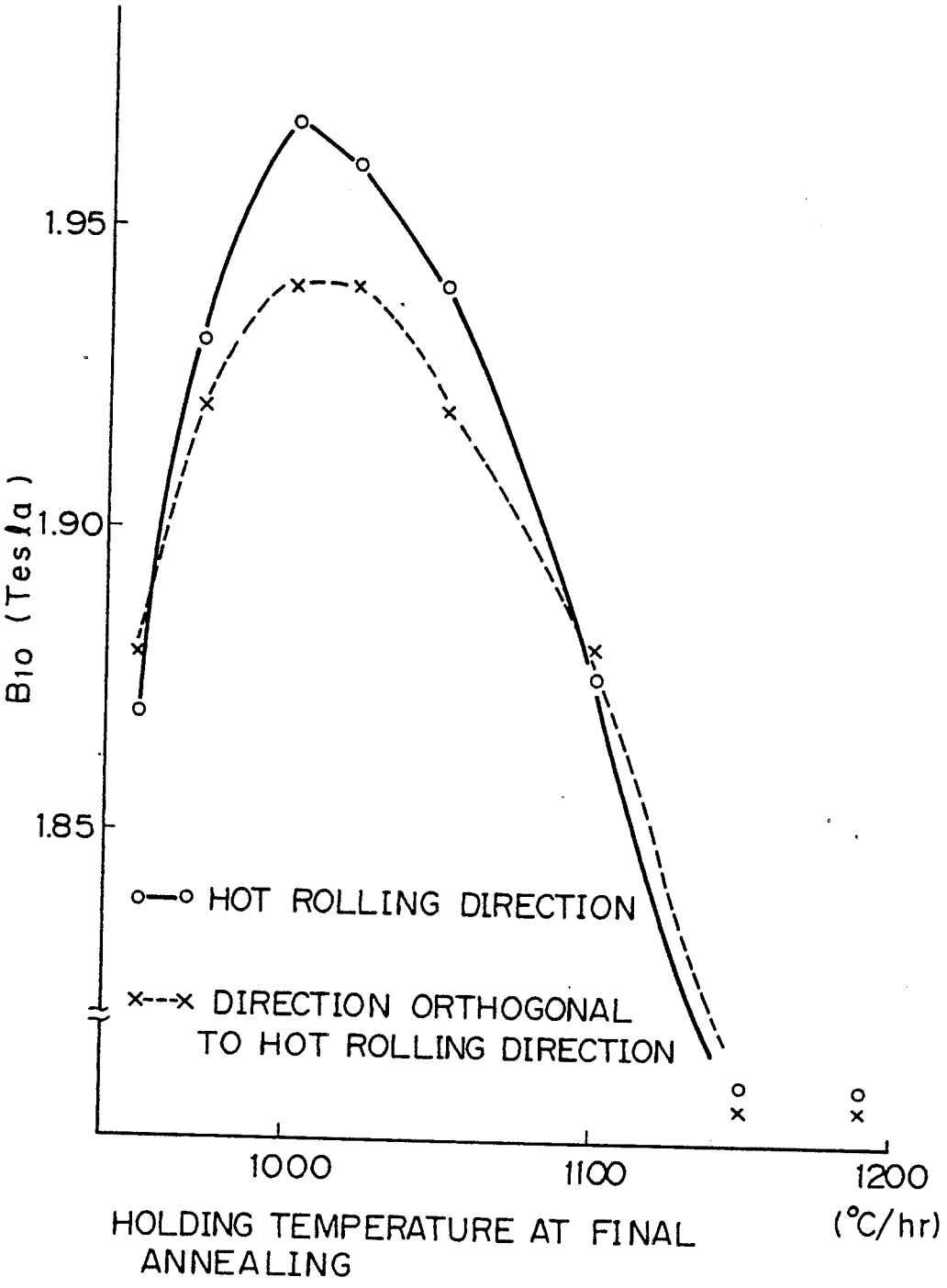
FIG. 1 is a diagram illustrating the relationship between the holding temperature at the final finish annealing and the flux density ($B_{10}$ value) of the product.

The process for the production of double-oriented electrical steel sheet according to the present invention will now be described in detail.

An ordinary hot-rolled silicon steel sheet can be used as the material to be cold-rolled. A hot-gauge sheet obtained directly by continuous casting of a molten steel, for example, thin steel sheet (strip) having a thickness of 1.5 to 3.0 mm, also can be used.

The material comprises 0.8 to 4.8% by weight of Si and 0.008 to 0.048% by weight of acid-soluble Al with the balance being Fe and unavoidable impurities. These are indispensable components, and other components are not particularly critical.

If the Si content exceeds 4.8% by weight, the material is often cracked at the cold rolling and the rolling becomes impossible to perform. To increase the flux density of the product, preferably the Si content is as low as possible, but if an $\alpha \rightarrow \gamma$ transformation occurs at the finish annealing, the orientation of the crystal is destroyed, and therefore, the Si content is restricted to a value of at least 0.8% by weight so that the orientation of the crystal is not substantially influenced by the $\alpha - \gamma$ transformation.

If the acid-soluble Al content is within the range of 0.008 to 0.048% by weight, a product having a flux density $B_{10}$ higher than 1.85 Tesla can be obtained, and especially, if the acid-soluble Al content is within the range of 0.018 to 0.036% by weight, the flux density $B_{10}$ of the product can be elevated to a level heretofore unattainable, i.e., a level higher than 1.92 Tesla.

Fe and unavoidable impurities constitute the balance.

The molten steel having the above-mentioned composition is formed into a thin steel sheet (hot gauge) by casting and hot rolling or directly by continuous casting, and the steel sheet obtained by the above-mentioned methods is annealed at a temperature of 750° to 1200° C. for a short time of 30 seconds to 30 minutes.

If the steel sheet is not subjected to the annealing at a temperature of 750° to 1200° C. for a short time of 30 seconds to 30 minutes, the flux density of the product is decreased, but this annealing results in an increase of the manufacturing cost. Accordingly, this annealing should be performed according to the desired level of flux density and in view of the manufacturing cost.

Then, the steel sheet is pickled and cold-rolled in one direction at a thickness reduction ratio of 40 to 80%, and the cold rolling is carried out at a thickness reduction ratio of 30 to 70% in the direction crossing said one direction.

If the direction of the first cold rolling is the same as the hot rolling or continuous casting direction of the material, the flux density of the product can be made higher than the flux density attained when the first cold rolling is conducted in a direction orthogonal to the hot rolling or continuous casting direction.

But, even if the direction of the first cold rolling is orthogonal to the hot rolling or continuous casting direction of the material, a double-oriented electrical steel sheet in which the orientation of the crystal is in $\{100\}<001>$ or in the vicinity thereof is similarly obtained.

The cold-rolled sheet is subjected to primary recrystallization and decarburization annealing at a temperature of 750° to 1000° C. for a short time in a wet hydrogen atmosphere, to remove a minute amount of C contained in the steel, if necessary.

An anneal separating agent is coated on the treated steel sheet, and the final finish annealing for effecting secondary recrystallization and purification is then carried out. The present invention is characterized in that, by restricting the temperature range for the secondary recrystallization at this final annealing, a double-oriented electrical steel sheet having a high flux density is produced.

As pointed out hereinbefore, the orientation of the crystal in the double-oriented electrical steel sheet is expressed as {100}<001> by Miller indices, but crystal grains expressed as {110}<uvw> are also present. An increase of the latter crystal grains results in a reduction of the flux density, and accordingly, to attain a high flux density, the secondary recrystallization in the orientation {110}<uvw> must be inhibited.

The present invention is based on the finding that, if the temperature for the secondary recrystallization is restricted to within 950° to 1100° C., the growth of grains in the orientation {110}<uvw> is inhibited and grains in the orientation {100}<001> are preferentially formed by the secondary recrystallization.

To prove the above-mentioned effect, the following experiment was conducted.

A hot-rolled steel sheet having a thickness of 1.8 mm and comprising 3.3% by weight of Si, 0.028% by weight of acid-soluble Al and 0.007% by weight of N, 0.055% by weight of C with the balance being Fe and unavoidable impurities, was annealed at 1125° C. for 2 minutes and then cold-rolled at a thickness reduction ratio of 55% in the same direction as the hot rolling direction. Then, the steel sheet was cold-rolled at a thickness reduction ratio of 52% in the direction crossing the above cold rolling direction to obtain a sheet having a final thickness of 0.35 mm. The coldrolled steel sheet was subjected to decarburization annealing at 810° C. for 210 seconds in a wet hydrogen atmosphere.

Then, an anneal separating agent composed mainly of MgO was coated on the steel sheet and the steel sheet was held at a predetermined temperature of within 950° to 1200° C. in an atmosphere comprising 10% of $N_2$ and 90% of $H_2$ to complete the secondary recrystallization. For example, the temperature of the treated steel sheet was elevated to 900° C. at a heating rate of 10° C./hr and then elevated to a predetermined temperature within the range of 950° to 1200° C. at a heating rate of 150° C./hr, and the sheet was held at this predetermined temperature for 30 hours to complete the secondary recrystallization.

Figure 2:
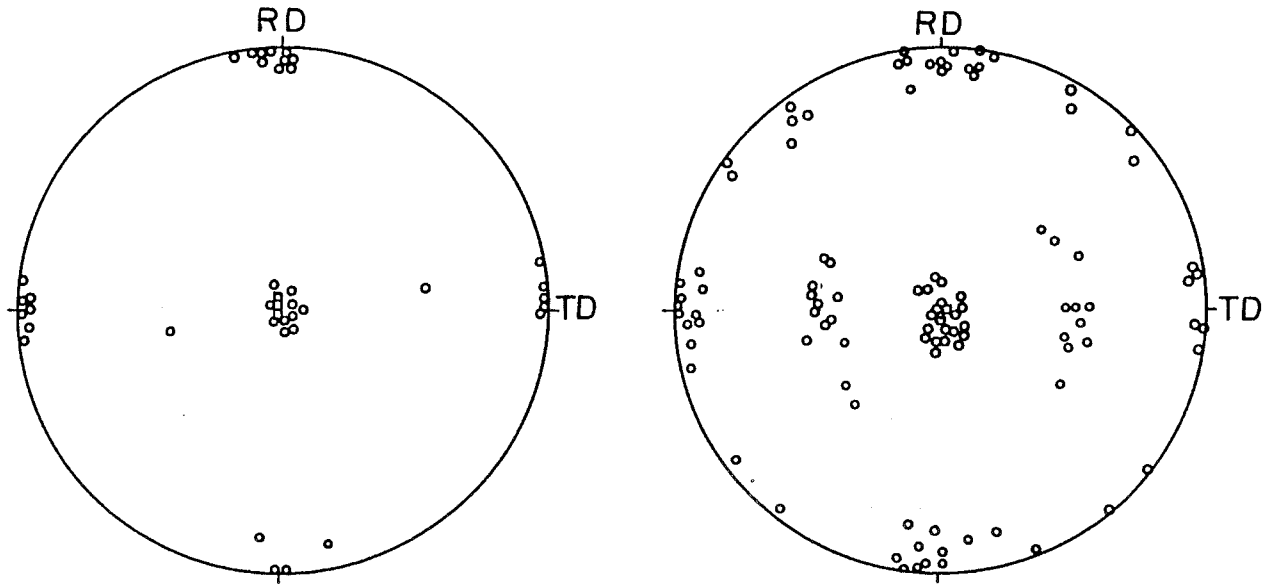
FIG. 2(*a*) is a (200) pole figure illustrating the grain orientation of a product in which the secondary recrystallization has been completed at 1000° C.

The relationship between the $B_{10}$ value of the obtained product and the holding temperature is shown in FIG. 1, and the orientation of the grains formed by the secondary recrystallization is shown in FIG. 2.

As apparent from FIG. 1, when the secondary recrystallization is completed by holding the steel sheet at a temperature of 950° to 1100° C., the flux value ($B_{10}$ value) exceeds 1.88 Tesla, and especially, when the secondary recrystallization is completed by holding the steel sheet at a temperature of 970° to 1050° C., the flux density ($B_{10}$ value) is conspicuously elevated and exceeds 1.92 Tesla.

From FIG. 2, it is understood that, when the holding temperature is maintained within the above-mentioned range, the secondary recrystallization in the orientation {110}<uvw> is inhibited and grains in the orientation {100}<001> preferentially grown.

Preferably the steel sheet is held at 950° to 1100° C. for at least 5 hours at final annealing. The preferred temperature range for the final annealing is from 970° to 1050° C.

Another specific method for controlling the secondary recrystallization temperature is that in which the heating rate within the above-mentioned temperature range is controlled. To confirm the effect of this method, the following experiment was carried out.

The same treated steel sheet as mentioned above was subjected to the final annealing by elevating the temperature of the treated steel sheet to 900° C. at a heating rate of 10° C./hr in an atmosphere comprising 10% of $N_2$ and 90% of $H_2$ and then elevating the temperature to 1200° C. at a predetermined heating rate of 5° to 150° C./hr.

Figure 3:
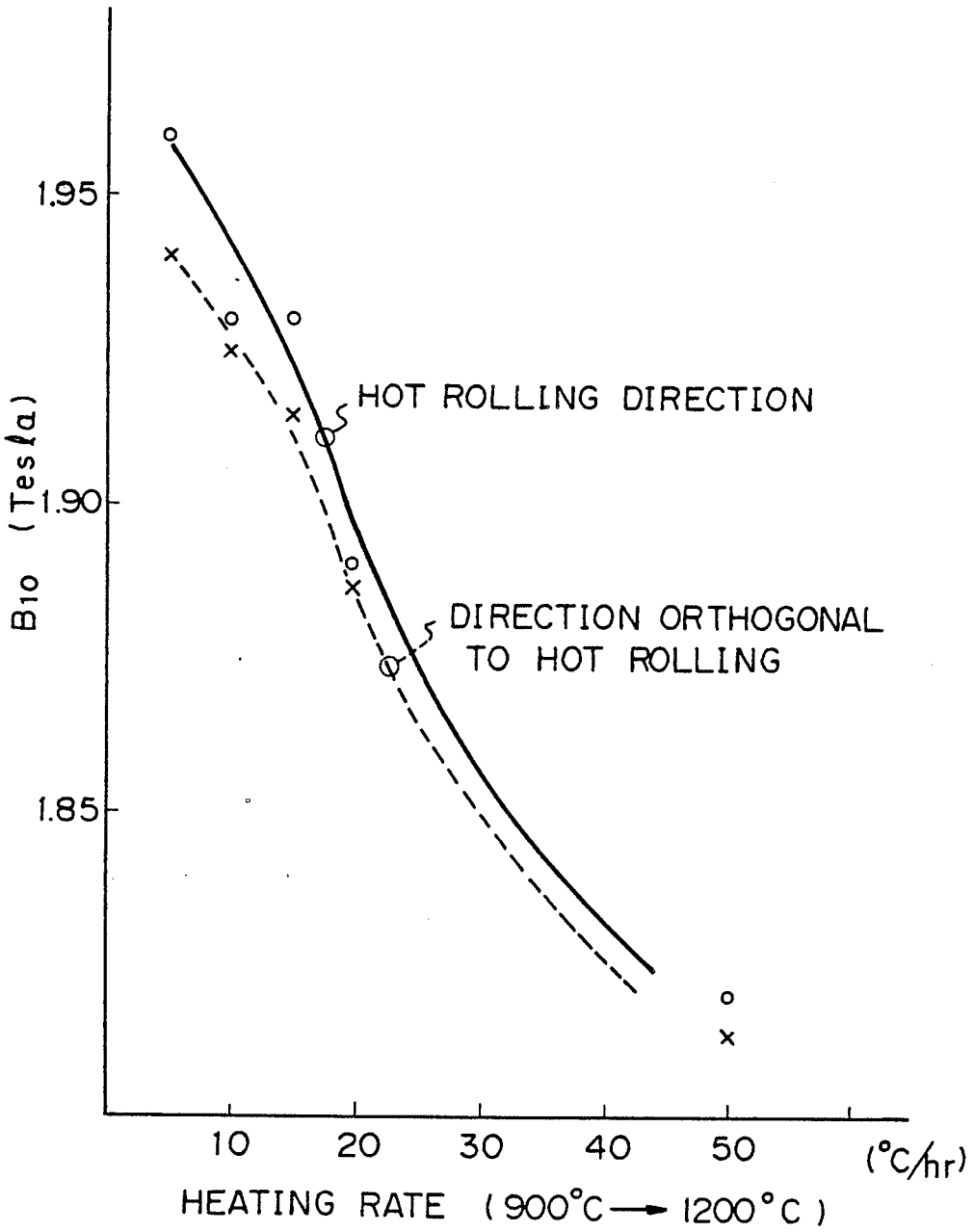
FIG. 3 is a diagram illustrating the relationship between the heating rate in the temperature range of from 900° to 1200° C. at the final finish annealing and the flux density ($B_{10}$) value of the product.

FIG. 3 illustrates the relationship between the flux density ($B_{10}$ value) of the product and the heating rate within the temperature range of 900° to 1200° C. From FIG. 3, it is apparent that, when the temperature-elevating rate is lower than 20° C./hr, the flux density ($B_{10}$ value) is higher than 1.88 Tesla and, especially, when the heating rate is lower than 15° C./hr, the flux density ($B_{10}$ value) is higher than 1.92 Tesla.

When the temperature of completion of the secondary recrystallization was examined at the heating rates of 5° C./hr, 15° C./hr and 25° C./hr, it was found that the temperatures of completion of the secondary recrystallization were 1010° C., 1045° C. and 1100° C., respectively. It is seen that these temperatures are within the above-mentioned recommended temperature range.

Preferably at the final annealing the temperature is elevated at a rate lower than 25° C./hr within a temperature range of from 950° to 1100° C., especially lower than 15° C./hr within a range of from 970° to 1050 ° C.

Another specific method for controlling the secondary recrystallization temperature is a nitriding treatment. This nitriding treatment is performed to cause a predetermined amount of nitrogen to intrude from the surface during the period of from the point of completion of the final cold rolling to the point of a manifestation of grains in the {100}<001> at the annealing step, whereby a higher flux density can be obtained.

The means used for an intrusion of nitrogen is not particularly critical. For example, a method can be adopted in which the steel sheet is nitrided in an atmosphere having a nitriding capacity, at the short-time annealing conducted for the decarburization and primary recrystallization after the final cold rolling, or at an additional annealing conducted after the decarburization annealing, or at the first stage of the final annealing (the stage at which a secondary recrystallization does not occur).

Where a large size strip coil is subjected to the nitriding treatment at final annealing, little nitrogen is allowed to intrude between layers of the strip, and it is feared that the nitriding of the steel sheet will not be sufficient. Accordingly, preferably a space having a size larger than a predetermined limit is maintained between layers of the strip, or a metal nitride or ammonia compound releasing nitrogen at the finish annealing step is added to the anneal separating agent to be coated on the surface of the strip prior to the finish annealing.

Nitrogen which has intruded into the steel sheet in the present invention is present probably in the form of fine precipitates of AlN, $Si_3N_4$ and (Al, Si)N and exerts the functions of elevating the secondary recrystallization temperature while inhibiting the grain growth of primary recrystallization grains and promoting the preferential growth of crystal grains in the orientation {100}<001>.

To examine the effect of this nitriding treatment, the additional annealing after the decarburization annealing was carried out in an ammonia-containing atmosphere, and the amount of nitrogen intruded into the steel sheet was changed by changing the annealing time, and the flux density of the product was measured. The following treatment was adopted for this test.

A hot-rolled steel sheet having a thickness of 1.65 mm and comprising 3.23% by weight of Si, 0.028% by weight of acid-soluble Al, 0.0073% by weight of total N and 0.055% by weight of C with the balance being Fe and unavoidable impurities was annealed at 1000° C. for 2 minutes, cold-rolled at a thickness reduction ratio of 65% in the same direction as the hot rolling direction and then cold-rolled at a thickness reduction ratio of 60% in the direction crossing the above cold rolling direction (substantially orthogonally thereto) to obtain a sheet having a final thickness of 0.23 mm.

The thus-obtained cold-rolled sheet was subjected to decarburization annealing at 810° C. for 90 seconds in a wet hydrogen atmosphere. The nitrogen content of the material after this decarburization annealing was 0.0075% by weight and the same as that of the starting material. At this point, the material is not nitrided.

The material which had been subjected to decarburization annealing was additionally annealed at 550° C. in an atmosphere containing 10% of $NH_3$ for 10 to 360 seconds to effect nitriding.

MgO was coated as the anneal-separating agent on the thus-obtained material, and the temperature was elevated at a rate of 30° C./hr in an atmosphere comprising 25% of $N_2$ and 75% of $H_2$ and purification annealing was carried out at 1200° C. for 20 hours in an atmosphere comprising 100% of $H_2$. The relationship between the flux density ($B_{10}$ value) of the obtained product and the increase of the amount of nitrogen by the additional annealing (the nitriding treatment of the steel sheet) conducted before the finish annealing is shown in FIG. 4.

Figure 4:
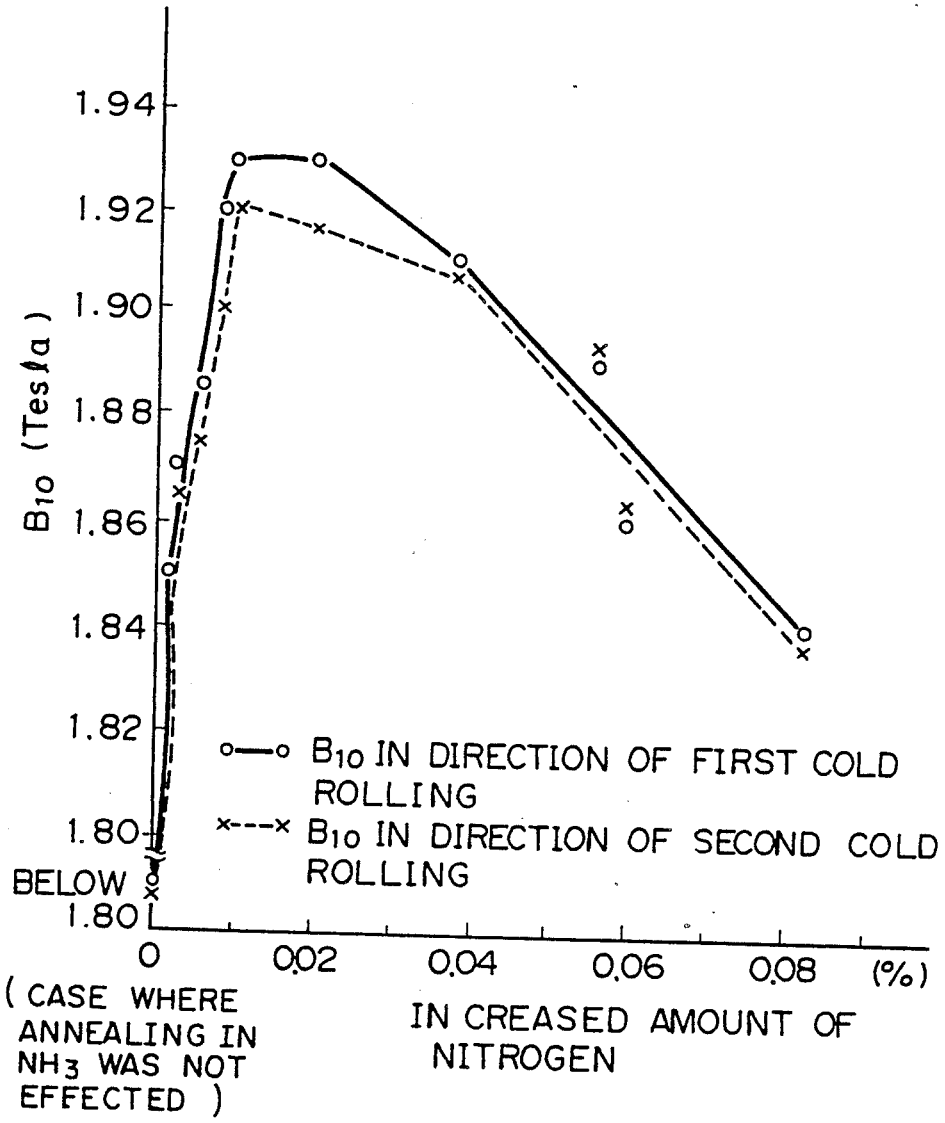
FIG. 4 is a diagram illustrating the relationship between the increase of the amount of nitrogen and the flux density ($B_{10}$ value) of the product.

As apparent from FIG. 4, if the nitrogen-increasing treatment is not carried out, the secondary recrystallization is not caused and the flux density ($B_{10}$ value) is low. On the other hand, if the amount of increase of nitrogen is too large, the size of crystal grains of the product becomes too large, and the frequency of appearance of grains having an orientation other than {100}<001> increases and the $B_{10}$ value is reduced.

If the amount of increase of nitrogen is within 0.002 to 0.060%, a $B_{10}$ value larger than 1.88 Tesla is obtained, and if the amount of increase of nitrogen is within 0.0060 to 0.0200%, a product having a highest flux density is obtained.

Even if this nitriding treatment is conducted on the material before the cold rolling, no effect is attained, and the intended effect is attained only when the nitriding treatment is conducted during the annealing step after the cold rolling.

If the nitriding treatment described above is added to the step of restricting the range of the temperature for the secondary recrystallization at the final annealing according to the present invention, as illustrated in the examples given hereinafter, a higher flux density can be stably obtained.

The technique of correcting the shape (flatness) of the material (strip) in the process of the present invention will now be described.

As the means of cold-rolling the material, in the form of a strip, in the direction orthogonal to the longitudinal direction of the strip, a cross cold rolling method disclosed, for example, in Japanese Examined Patent Publication No. 62-45007 can be adopted. By this cross cold rolling method, relatively high magnetization characteristics ($B_{10}$ value) can be obtained, but the shape of the rolled material (strip) is unsatisfactory. Accordingly this method is not practically adopted as the cross cold rolling method for industrial products. More specifically in the first place, in this cold rolling method, since the material is intermittently rolled, the thickness is increased at the boundaries between every two passes, the thickness becomes uneven in the longitudinal direction, and thus the product is not suitable as the material of a laminated iron core.

In the second place, since the stress is applied in the transverse direction of the material, a flexural stress is produced in the plane of the material at the boundary between the deformed portion and the undeformed portion and edge wave (undulation) is formed on the side edge of the material, and a shape (flatness) required for the material of a laminated iron core cannot be maintained.

The inventors found that, when the continuous third cold rolling is carried out after the above-mentioned cross cold rolling in the direction orthogonal to the said second rolling direction, i.e., in the same direction as the first cold rolling direction, and the thickness reduction ratio at this treatment is restricted to 5 to 33%, the thickness in the longitudinal direction can be uniformalized and the shape (flatness) of the rolled material (strip) can be improved, and the flux density of the final product can be increased. This was confirmed by the following experiment.

A hot-rolled steel sheet having a thickness of 2.3 mm and comprising 0.053% by weight of C, 3.2% by weight of Si, 0.080% by weight of Mn, 0.023% by weight of S, 0.033% by weight of Al and 0.0075% by weight of N with the balance being substantially Fe was annealed at a temperature of 1100° C. for 2 minutes, and continuous cold rolling was carried out in the same direction as the hot rolling direction by using a roll type rolling machine (for example, an ordinary 4-stage cold rolling machine) so that the thickness was reduced to 1.1 mm, whereby a strip coil was formed. Then, cold rolling (cross rolling) was carried out in the direction orthogonal to the direction of the above-mentioned first rolling by the method disclosed in Japanese Examined Patent Publication No. 62-45007 so that the thickness was reduced to 0.55 mm. Then, the strip coil was subjected to the continuous cold rolling treatment at a thickness reduction of 5 to 50% in the same direction as the first cold rolling by the same rolling machine of the rolling roll type.

A comparative material in which the above-mentioned cold rolling at a reduction ratio of 5 to 50% was not effected was subjected to the post treatment after the cold rolling.

These cold-rolled sheets were subjected to decarburization annealing at 820° C. for 5 minutes in a wet hydrogen atmosphere, and MgO was coated on the sheets and the high-temperature finish annealing was carried out at 1200° C. for 20 hours.

Figure 5:
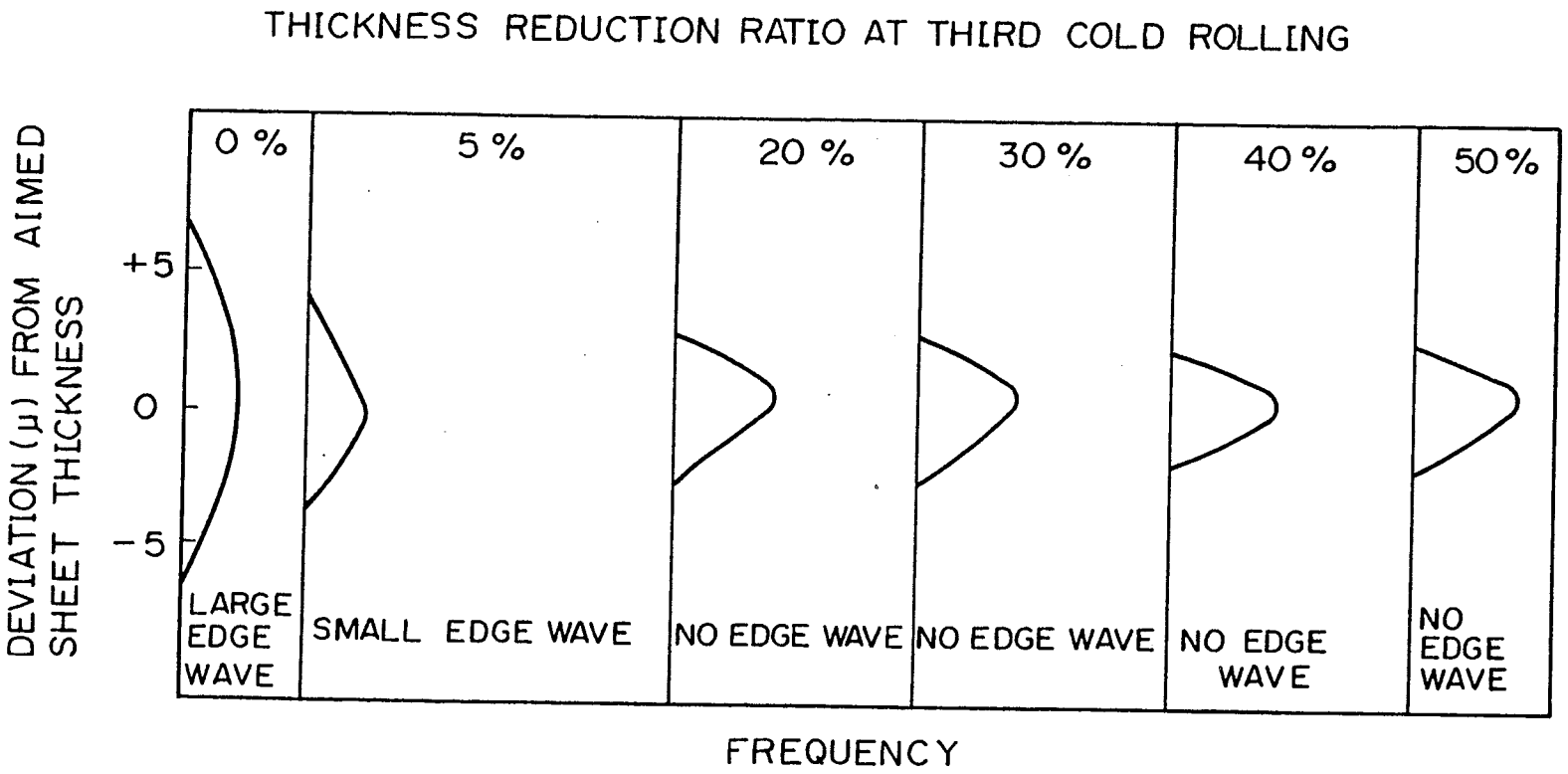
FIG. 5 is a diagram illustrating the relationship between the thickness reduction ratio at the third cold rolling conducted in the same direction as that of the first cold rolling after the cross cold rolling and the shape of the strip.

The flux density, the thickness deviation in the longitudinal direction, and the shape (flatness) were examined, and the results are shown in FIG. 5.

As seen from FIG. 5, without the third cold rolling, the thickness deviation in the longitudinal direction of the product was large and undulations (ear waves) on both the side edges of the product did not disappear, and therefore, the product could not be practically used and marketed.

In contrast, if the third cold rolling was carried out at a thickness reduction ratio of at least 5% in the same direction as the first cold rolling direction after the cross cold rolling, the above-mentioned problem did not arise. It is also found that if a thickness reduction ratio higher than 33% was adopted at the cold rolling after the cross cold rolling, as shown in FIG. 6, the flux density was drastically degraded.

Figure 6:
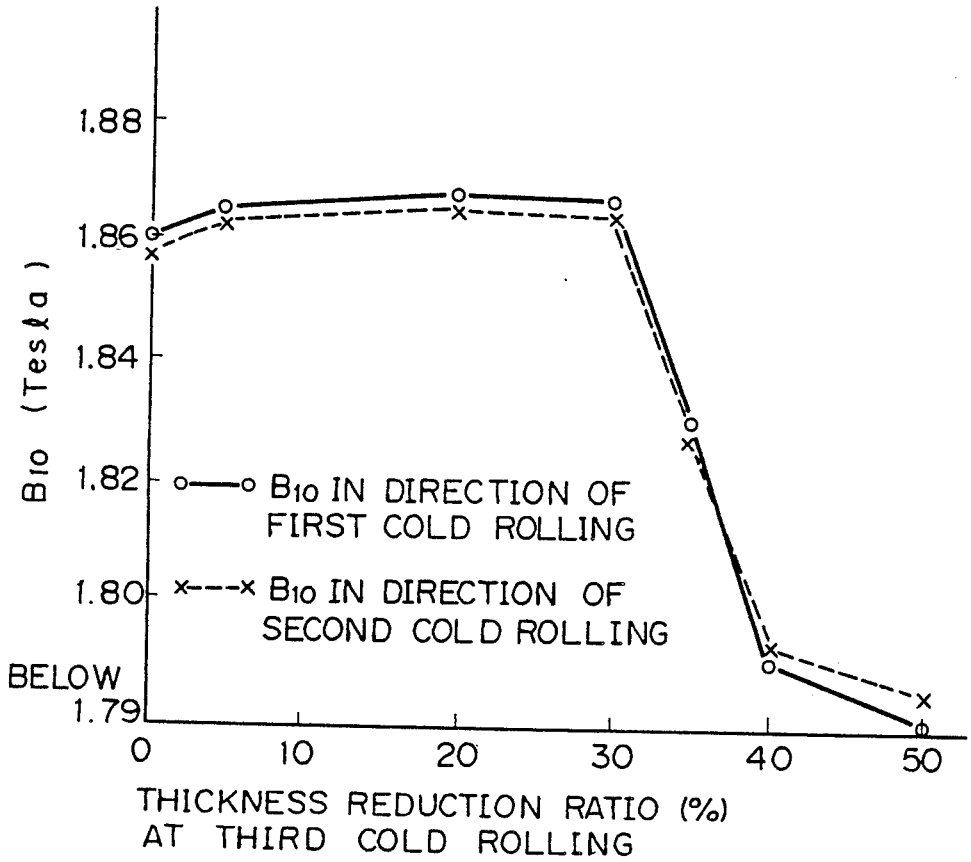
FIG. 6 is a diagram illustrating the relationship between the thickness reduction ratio at the third cold rolling conducted in the same direction as that of the first cold rolling after the cross cold rolling and the flux density ($B_{10}$ value) of the product.

From FIG. 6, it is seen that, if the cold rolling (third cold rolling) after the cross cold rolling is carried out at a thickness reduction ratio within the above-mentioned range, the flux density ($B_{10}$ value) is increased above 1.85 Tesla over the flux density of the product obtained by the ordinary cross cold rolling. Accordingly, if the above-mentioned secondary recrystallization and nitriding treatments of the present invention are carried out after the third cold rolling, the flux density of the product can be further increased.

The present invention will now be described in detail with reference to the following examples.

EXAMPLE 1

A hot-rolled steel sheet having a thickness of 1.65 mm and comprising 3.40% by weight of Si, 0.023% by weight of acid-soluble Al, 0.0072% by weight of total N, 0.04% by weight of C, and 0.14% by weight of Mn with the balance being Fe and unavoidable impurities was annealed at 1070° C. for 2 minutes and cold-rolled at a thickness reduction ratio of 65% in the same direction as the hot rolling direction. Then, the cold rolling was carried out at a thickness reduction ratio of 60% in the direction crossing the above cold rolling direction to obtain a final sheet thickness of 0.23 mm. This cold-rolled sheet was subjected to the decarburization annealing at 810° C. for 90 seconds in a wet hydrogen atmosphere. Then, MgO was coated as the anneal separating agent, and the finish annealing was carried out in an atmosphere comprising 10% of $N_2$ and 90% of $H_2$ according to one of the following three annealing cycles.

(A) The temperature was elevated to 1200° C. at a rate of 30° C./hr.

(B) The temperature was elevated to 900° C. at a rate of 30° C./hr and was then elevated to 1200° C. at a rate of 5° C./hr.

(C) The temperature was elevated to 1020° C. at a rate of 30° C./hr, the sample was held at this temperature for 5 hours, and the temperature was elevated to 1200° C. at a rate of 30° C./hr.

The magnetic characteristics of the obtained products were measured, and the results are shown in Table 1.

TABLE 1

| Annealing Cycle | Magnetization Characteristics ($B_{10}$ value; Tesla) hot rolling direction | orthogonal direction |
|---|---|---|
| (A) | 1.81 | 1.78 |
| (B) | 1.92 | 1.92 |
| (C) | 1.94 | 1.93 |

EXAMPLE 2

A hot-rolled steel sheet having a thickness of 1.65 mm and comprising 3.40% by weight of Si, 0.023% by weight of acid-soluble Al, 0.0035% by weight of total N, 0.048% by weight of C, and 0.14% by weight of Mn with the balance being Fe and unavoidable impurities was annealed at 1070° C. for 2 minutes and cold-rolled at a thickness reduction ratio of 65% in the same direction as the hot rolling direction. Then, the steel sheet was further cold-rolled at a thickness reduction ratio of 60% in the direction crossing the above cold rolling direction to obtain a final sheet thickness of 0.23 mm.

The cold-rolled sheet was subjected to decarburization annealing at 810° C. for 90 seconds in a wet hydrogen atmosphere.

MgO containing 0, 2, 5 or 10% of MnN was coated as the anneal separating agent on the cold-rolled sheet, and the temperature was elevated to 1200° C. at a rate of 30° C./hr in an atmosphere comprising 10% of $N_2$ and 90% of $H_2$, and the finish annealing for purification was carried out at 1200° C. for 20 hours in an atmosphere comprising 100% of $H_2$. The results are shown in Table 2.

From the results shown in Table 2, it is understood that, if MnN is not added and the amount of increase of nitrogen is small, the $B_{10}$ value of the product is small, and on the other hand, if MnN is added to the anneal separating agent and the amount of nitrogen is large.

TABLE 2

| Amount (%) of MnN in Anneal Separating Agent | Increased Amount of Total N in Steel Sheet | $B_{10}$ (Tesla) hot rolling direction | orthogonal direction |
|---|---|---|---|
| 0 | 0.0010 | 1.80 | 1.76 |
| 2 | 0.0060 | 1.89 | 1.85 |
| 5 | 0.0090 | 1.92 | 1.90 |
| 10 | 0.0140 | 1.95 | 1.94 |

EXAMPLE 3

A hot-rolled steel sheet having a thickness of 2.0 mm and comprising 2.0% by weight of Si, 0.032% by weight of acid-soluble Al, 0.0035% by weight of N, 0.048% by weight of C, 0.14% by weight of Mn, and 0.012% by weight of S was annealed at 1120° C. for a short time of 2 minutes, and the material was cold-rolled so that the thickness was reduced to 0.70 mm. The sheet in the form of a strip was subjected to the cross cold rolling in the direction orthogonal to the first cold rolling direction according to the method disclosed in Japanese Examined Patent Publication No. 62-45007 so that the thickness was reduced to 0.23 mm. Then, the strip was cold-rolled in the same direction as the first cold rolling direction by an ordinary cold rolling machine so that the thickness was reduced to 0.20 mm. The obtained cold-rolled sheet was subjected to decarburization annealing at 810° C. for 90 seconds in a wet hydrogen atmosphere. Then, MgO containing 0, 2, 5 or 10% of MnN was coated as the anneal separating agent and the temperature was elevated to 1200° C. at a rate of 30° C./hr in an atmosphere comprising 10% of $N_2$ and 90% of $H_2$, and the high-temperature finish annealing was carried out in an atmosphere comprising 100% of $H_2$. The $B_{10}$ value of the obtained product and the amount of total nitrogen of the material sampled when heating was stopped (supply of electricity was stopped) at 900° C. during the above elevation of the temperature in the atmosphere comprising 10% of $N_2$ and 90% of $H_2$ are shown in Table 3.

TABLE 3

| Amount (%) of MnN in Anneal Separating Agent | Increased Amount (%) of Total N in Steel Sheet | $B_{10}$ (Tesla) first cold rolling direction | $B_{10}$ (Tesla) second cold rolling direction |
|---|---|---|---|
| 0 | 0.0012 | 1.83 | 1.79 |
| 2 | 0.0072 | 1.90 | 1.90 |
| 5 | 0.0098 | 1.93 | 1.92 |
| 10 | 0.0160 | 1.96 | 1.95 |

EXAMPLE 4

A hot-rolled steel sheet having a thickness of 1.8 mm and comprising 3 1% by weight of Si, 0.029% by weight of acid-soluble Al, 0.0072% by weight of N, 0.05% by weight of C, 0.08% by weight of Mn, and 0.018% by weight of S was annealed at 1070° C. for a short time of 2 minutes and cold-rolled in the longitudinal direction of the material so that the thickness was reduced to 0.68 mm. Then, the sheet in the form of a strip was subjected to the cross cold rolling in the direction orthogonal to the first cold rolling direction by the method disclosed in Japanese Examined Patent Publication No. 62-45007 so that the thickness was reduced to 0.23 mm. Then, the sheet was subjected to the continuous cold rolling in the same direction as the first cold rolling direction by using an ordinary cold rolling machine so that the thickness was reduced to 0.20 mm. Then, the cold-rolled sheet was subjected to the decarburization annealing at 810° C. for 90 minutes in a wet hydrogen atmosphere, and MgO containing 5% of MnN was coated as the anneal separating agent on the cold-rolled sheet. The temperature was elevated to 1000° C. at a rate of 20° C./hr in an atmosphere comprising 25% of $N_2$ and 75% of $H_2$, and the steel sheet was maintained at 1000° C. for 10 hours. Then, the temperature was elevated to 1200° C. and the purification annealing was conducted at this temperature for 20° C./hr in an atmosphere comprising 100% of $H_2$. The $B_{10}$ value of the obtained product was measured. The results are shown in Table 4.

TABLE 4

| Acid-Soluble Al Content (%) in Starting Steel | $B_{10}$ (Tesla) first cold rolling direction | $B_{10}$ (Tesla) second cold rolling direction |
|---|---|---|
| 0.029 | 1.96 | 1.95 |

EXAMPLE 5

A hot-rolled steel sheet having the same composition as that of the hot-rolled steel sheet used in Example 1 and a thickness of 1.8 mm was used in the as-hot-rolled state or after annealing at 950° C. for 2 minutes or at 1070° C. for 2 minutes. The hot-rolled steel sheet was cold-rolled at a thickness reduction ratio of 63% in the same direction as the hot rolling direction and was then cold-rolled at a thickness reduction ratio of 55% in the direction crossing the above cold rolling direction to obtain a final thickness of 0.30 mm. Then, each of the thus-obtained cold-rolled steel sheets was subjected to decarburization annealing at 810° C. for 120 seconds in a wet hydrogen atmosphere. Then MgO containing 10% of MnN was coated as the anneal separating agent on the steel sheet, and the temperature was elevated to 1000° C. at a rate of 25° C./hr in an atmosphere comprising 10% of $N_2$ and 90% of $H_2$ and the steel sheet was maintained at 1000° C. and for 20 hours to complete the secondary recrystallization. Then, the purification annealing was carried out at 1200° C. for 20 hours in an atmosphere comprising 100% of $H_2$. The magnetic characteristics of the obtained products were measured. The results are shown in Table 5.

TABLE 5

| Annealing of Hot-Rolled Steel Sheet | Magnetization Characteristics ($B_{10}$ value: Tesla) hot rolling direction | Magnetization Characteristics ($B_{10}$ value: Tesla) orthogonal direction |
|---|---|---|
| not effected | 1.88 | 1.85 |
| effected at 950° C. | 1.94 | 1.93 |
| effected at 1070° C. | 1.96 | 1.94 |

EXAMPLE 5

Al was added to a molten steel comprising 3.25% by weight of Si, 0.0065% by weight of total N, 0.051% by weight of C and 0.12% by weight of Mn with the balance being Fe and unavoidable impurities so that the acid-soluble Al content was 0.005, 0.009, 0.020, 0.032 or 0.058% by weight. A hot-rolled steel sheet having a thickness of 2.0 mm was obtained from this melt and the hot-rolled sheet was annealed at 1070° C. for 2 minutes. Then, the steel sheet was cold-rolled at a thickness reduction ratio of 67% in the same direction as the hot rolling direction and the steel sheet was then cold-rolled at a thickness reduction ratio of 55% in the direction crossing the above cold rolling direction to obtain a final sheet thickness of 0.30 mm.

The cold-rolled steel sheet was subjected to decarburization annealing at 810° C. for 120 seconds, and the nitrogen amount-increasing treatment was carried out at 800° C. for 60 seconds.

The nitrogen content in the streated steel sheet was 0.028% by weight. MgO was coated as the anneal separating agent on the material (steel sheet) and the temperature was elevated to 1000° C. at a rate of 30° C./hr in an atmosphere comprising 10% of $N_2$ and 90% of $H_2$, the sheet was maintained at this temperature for 10 hours, and the temperature was elevated to 1200° C. at a rate of 50° C./hr, and purification was carried out at 1200° C. for 20 hours in an atmosphere comprising 100% of $H_2$.

The $B_{10}$ values of the obtained products were measured. The results are shown in Table 6.

From the results shown in Table 6, it is understood that, if acid-soluble Al is contained in an amount specific in the present invention, a product having a large $B_{10}$ value can be obtained.

TABLE 6

| Acid-Soluble Al Content (%) | $B_{10}$ Value (Tesla) hot rolling direction | orthogonal direction |
|---|---|---|
| 0.005 | 1.81 | 1.78 |
| 0.009 | 1.92 | 1.92 |
| 0.020 | 1.93 | 1.93 |
| 0.032 | 1.95 | 1.94 |
| 0.058 | 1.75 | 1.78 |

EXAMPLE 7

A hot-rolled steel sheet having the same composition as that of the steel sheet used in Example 1 and a thickness of 1.4 mm was annealed at 1070° C. for 2 minutes, and the steel sheet was cold-rolled at a thickness reduction ratio of 50 or 65% in the same direction as the hot rolling direction and the steel sheet was then cold-rolled at a thickness reduction ratio of 67 or 53% in the direction crossing the above cold rolling direction to obtain a final sheet thickness of 0.23 mm.

Separately, the hot-rolled steel sheet was annealed at 1070° C. for 2 minutes, and the hot-rolled steel sheet was cold-rolled at a thickness reduction ratio of 50 or 65% in the direction crossing the hot rolling direction and was then cold-rolled at a thickness reduction ratio of 67 or 53% in the direction crossing the above cold rolling direction to obtain a final sheet thickness of 0.23 mm.

Each of the thus-obtained cold-rolled sheets was subjected to decarburization annealing at 810° C. for 90 seconds.

MgO containing 10% of MnN was coated on the obtained material, and the temperature was elevated to 1050° C. at a rate of 30° C./hr in an atmosphere comprising 10% of $N_2$ and 90% of $H_2$ and the steel sheet was maintained at this temperature for 5 hours. Then, the temperature was elevated to 1200° C. at a rate of 50° C./hr, and purification was carried out at 1200° C. for 20 hours in an atmosphere comprising 100% of $H_2$.

The $B_{10}$ values of the obtained products were measured, and the results are shown in Table 7.

TABLE 7

| Thickness Reduction Ratio at Cold Rolling: first cold rolling | second cold rolling | $B_{10}$ (Tesla): first cold roll direction | crossing direction at second cold rolling |
|---|---|---|---|
| 50%, hot-rolling direction | 67%, crossing direction | 1.87 | 1.89 |
| 65%, hot-rolling direction | 53%, crossing direction | 1.94 | 1.93 |
| 50%, direction orthogonal to hot rolling direction | 67%, crossing direction | 1.86 | 1.89 |
| 65%, direction orthogonal to hot rolling direction | 53%, crossing direction | 1.91 | 1.92 |

As apparent from the foregoing description, according to the present invention, a double-oriented electrical steel sheet having, in two directions, a $B_{10}$ value comparable or superior to the highest level of the $B_{10}$ value now available in grain-oriented electrical steel sheets, and having an excellent shape (flatness) and a much smaller thickness deviation in the longitudinal direction of the product can be produced, in the form of a strip, on an industrial scale.

We claim:

1. A process for the production of a double-oriented electrical steel sheet, which comprises annealing a silicon steel sheet comprising 0.8 to 4.8% by weight of Si and 0.008 to 0.048% by weight of acid-soluble Al with the balance comprising Fe and unavoidable impurities at a temperature ranging from 750° to 1200° C., cold-rolling the steel sheet at a thickness reduction ratio of 40 to 80%, further cold-rolling the steel sheet at a thickness reduction ratio of 30 to 70% in the direction crossing the rolling direction at said first cold rolling, subjecting the cold-rolling steel sheet to decarburization annealing, and then carrying out final annealing, wherein said final annealing comprises (1) developing and completing secondary recrystallization at a temperature of from 950° to 1100° C., and, following completion of secondary recrystallization, (2) purifying the steel sheet at a temperature above 1100° C.

2. A process according to claim 1, wherein at the final annealing, the steel sheet is held at a temperature of 950° to 1100° C. for at least 5 hours.

3. A process according to claim 2, wherein at the final annealing, the temperature is elevated at a rate lower than 25° C./hr within a temperature range of from 950° to 1100° C.

4. A process according to claim 2, wherein at the final annealing, the steel sheet is maintained at a temperature ranging from 970° to 1050° C.

5. A process according to claim 2, wherein at the final annealing, the temperature is elevated at a rate lower than 15° C./hr within a temperature range of from 970° to 1050° C.

6. A process according to claim 1, which further comprises nitriding the steel sheet during the period from the decarburization annealing conducted after the final cold rolling to prior to the development of the secondary recrystallization at the final annealing, to increase the amount of nitrogen in the steel sheet by 0.002 to 0.06%.

7. A process according to claim 6, wherein at the final annealing, the steel sheet is held at a temperature of 950° to 1100° C. for at least 5 hours.

8. A process according to claim 6, wherein at the final annealing, the temperature is elevated at a rate lower than 25° C./hr within a temperature range of from 950° to 1100° C.

9. A process according to claim 6, wherein at the final annealing, the steel sheet is maintained at a temperature ranging from 970° to 1050° C.

10. A process according to claim 6, wherein at the final annealing, the temperature is elevated at a rate lower than 15° C./hr within a temperature range of from 970° to 1050° C.

11. A process according to claim 1, wherein after the second cold rolling conducted at a thickness reduction ratio of 30 to 70%, the third cold rolling is carried out at a thickness reduction ratio of 5 to 33% in the same direction as the direction of the first cold rolling.

12. A process according to claim 11, wherein at the final annealing, the steel sheet is held at a temperature of 950° to 1100° C. for at least 5 hours.

13. A process according to claim 11, wherein at the final annealing; the temperature is elevated at a rate lower than 25° C./hr within a temperature range of from 950° to 1100° C.

14. A process according to claim 11, wherein at the final annealing, the steel sheet is maintained at a temperature ranging from 970° to 1050° C.

15. A process according to claim 11, wherein at the final annealing, the temperature is elevated at a rate lower than 15° C./hr within a temperature range of from 970° to 1050° C.

16. A process according to claim 11, which further comprises nitriding the steel sheet during the period from the decarburization annealing conducted after the final cold rolling to prior to the development of the secondary recrystallization at the final annealing, to increase the amount of nitrogen in the steel sheet by 0.002 to 0.06%

17. A process according to claim 16, wherein at the final annealing, the steel sheet is held at a temperature of 950° to 1100° C. for at least 5 hours.

18. A process according to claim 16, wherein at the final annealing, the temperature is elevated at a rate lower than 25° C./hr within a temperature range of from 950° to 1100° C.

19. A process according to claim 16, wherein at the final annealing, the steel sheet is maintained at a temperature ranging from 970° to 1050° C.

20. A process according to claim 16, wherein at the final annealing, the temperature is elevated at a rate lower than 15° C./hr within a temperature range of from 970° to 1050° C.

* * * * *